US006493880B1

(12) United States Patent
Lo

(10) Patent No.: US 6,493,880 B1
(45) Date of Patent: Dec. 17, 2002

(54) ADJUSTABLE HEADWEAR

(76) Inventor: David Lo, 206 Beech Ct, Norwood, NJ (US) 07648

( * ) Notice: Subject to any disclaimer, the term of this patent is extended or adjusted under 35 U.S.C. 154(b) by 0 days.

(21) Appl. No.: 09/911,967

(22) Filed: Jul. 24, 2001

(51) Int. Cl.[7] ..... A42B 1/00
(52) U.S. Cl. ..... 2/195.2
(58) Field of Search ..... 2/195.1, 195.2, 2/195.3, 181, 410, 183, 184, 171, 918, 171.1, 195.6, 195.7, 195.8, 175.3, 175.4, 175.5, 417, 418, 200.1, DIG. 11; 66/169 R, 170, 171, 190, 195, 202; 139/420 R, 421, 422

(56) References Cited

U.S. PATENT DOCUMENTS

| | | | | | |
|---|---|---|---|---|---|
| 2,106,075 | A | | 1/1938 | Tabley | |
| 2,294,654 | A | * | 9/1942 | Cooper | 2/181 |
| 3,309,713 | A | * | 3/1967 | Kaufman | 2/183 |
| 4,141,229 | A | * | 2/1979 | Sharpe | 66/171 |
| 4,274,157 | A | | 6/1981 | Boden | |
| 4,662,007 | A | | 5/1987 | Lipkin | |
| 5,099,524 | A | | 3/1992 | Linday | |
| 5,119,514 | A | | 6/1992 | Woehl | |
| 5,153,939 | A | | 10/1992 | Howe et al. | |
| 5,715,540 | A | | 2/1998 | Cho | |
| 6,016,572 | A | * | 1/2000 | Park | 2/175.1 |
| 6,067,658 | A | * | 5/2000 | Cho | 2/181 |
| 6,163,888 | A | * | 12/2000 | Park | 2/183 |

* cited by examiner

*Primary Examiner*—John J. Calvert
*Assistant Examiner*—Tejash Patel
(74) *Attorney, Agent, or Firm*—Morgan & Finnegan, LLP

(57) ABSTRACT

The present invention relates generally to adjustable headwear in the form of caps or visors which are adjustable to fit wearers with a range of head sizes. In particular, the cap or visor is constructed of a uni-axially stretchable material with a sweatband around the inside periphery of the cap or visor constructed of a bi-axially stretchable material. Attached to the front of the headwear is a bill, a rigid structure that shields the wearer's eyes and is arched in the preferred embodiment.

7 Claims, 3 Drawing Sheets

ADJUSTABLE HEADWEAR

BACKGROUND OF INVENTION

The present invention relates generally to an adjustable headwear in the form of a cap or a visor which is adjustable to fit a range of head sizes. In particular, the cap or visor is constructed of a uni-axially stretchable material with a bi-axially stretchable sweatband around the inside periphery of the cap or visor. Attached to the front of the headwear is a bill, a rigid structure that shields the wearer's eyes and is preferably arched.

In the past, attempts have been made to provide a cap, such as a baseball cap, which can fit different wearers in a range of head sizes. A common way for adjusting the size of the cap employs an adjustable strap disposed at the back of the cap for adjustment by the wearer. Typically, attached to one side of the rear of the cap is a variable-length strap with holes for receiving a projecting snap fastener element provided on another portion of the cap, for example on another strap also attached to the other side of the rear of the cap. This arrangement is referred to as a snap back arrangement, referring to the location of the snap in the back of the cap. An open area is disposed above the portion of the cap having the adjustable-length strap, to permit the adjustment to be made without significantly distorting the shape of the cap. Such caps are in widespread use today, and such adjustable size caps are also referred to hereafter as multi-size caps.

Typically, such multi-size caps are created through the use of the above-mentioned variable-length snap arrangement, to accommodate head or hat sizes ranging from 7 inches to 7 ¾inches in ⅛inch increments. However, in case of someone with the head size between 7 and 7 ⅛, the fit is not exact. An improper adjustment in size lacks comfort and with time causes the shape of the cap to change. A further disadvantage is that the opening in the back and the snap arrangement itself detracts from the aesthetics of the cap. Using a mating hook-and-loop fastener (e.g., VELCRO® fasteners) for the size adjustment does not solve the above problems associated with the known multi-size caps. The use of such fasteners often becomes inadvertently undone causing the cap to fall off the wearer's head. Moreover, the hook-and-loop fasteners are rather stiff and are uncomfortable. Furthermore, where the adjustment is improper, it causes the cap body to wrinkle and be distorted.

Single size caps do not have t he aforementioned defects, but they are costly to manufacture and require a manufacturer and a retailer to carry a very substantial inventory so as to have available a sufficient number of caps in each specific size. For example, to stock 10 caps in each of 10 sizes, for 10 different cap styles, and in 10 different colors, would already require stocking 10,000 caps. Even then, the single size cap, not being custom fitted, only approximates the wearer's head size, and therefore does not fit exactly and can be uncomfortable.

Multi-size caps have been described to overcome the problems associated with the single size caps and the snap back arrangement. U.S. Pat. No 4,274,157 describes a ventilated cap having an adjustable sweatband secured to the front of the cap with VELCRO® fasteners. The degree of adjustment is limited by the short VELCRO® fasteners. The insertion of the band with the VELCRO® fasteners forces the cap forward on the head distorting the shape and making the cap less comfortable and less aesthetically appealing.

U.S. Pat. No. 4,662,007 describes a cap with an elongated band to serve as ear flaps. The size of the cap is adjusted by the use of a stretchable fabric for the crown of the cap and having the ear flap band folded into the cap. However, the amount of stretch in a single direction provided by the crown is limited and the fit can be a problem when the ear flap band is unfolded for use in cold weather.

A segmented cap is described in U.S. Pat. No. 5,099,524 wherein the size is adjusted by the use of a sweatband with a rigid portion, a VELCRO® strip in the front and an elastic at the back. The sweatband is then attached to a bill portion and a crown portion by corresponding VELCRO® strips.

Another example of a known multi-size cap is shown in U.S. Pat. No. 5,153,939 to Howe. This reference teaches a hat structure formed of a knit fabric body and having a removable headband. The headband is attached to a body via hook-and-loop fasteners mounted on the headband and the hat body.

The hat of the Howe patent is constructed by using weft yam in combination with elastic yam and non-elastic warp yam. The material is 20% uni-axially stretchable. It also includes an ear flap made of weft knitted fabric located along the crown beginning and ending in the bill portion. The ear flaps are provided for the comfort of the wearer during cold weather. The ear flaps in the Howe reference are folded up when not in use and may be used as a sweatband. However, due to the width and thickness of the ear flaps, in instances when a wearer's head exactly fits the cap when the ear flaps are down, the cap will not fit properly once the flaps are folded up because the thickness of the ear flaps cannot be accommodated by the cap body, which is not stretchable.

A headband is shown in U.S. Pat. No. 2,106,075 to Tabley. This reference specifically teaches a sweatband made of an inflexible material such as silk, silk and cotton, or rayon silk. It does not teach a structure composed of a stretchable material.

Another cap is shown in U.S. Pat. No. 5,119,514 to Woehl. This reference teaches constructions of a cap having a rear gore in the crown of a stretchable material to provide size adjustment. It also teaches a cap spanned by a tab which may be an elastic band, a mating hook-and-loop fastener, or a snap fastener adjustable to variable lengths to fit a variety of head sizes. The Woehl reference does not disclose a headpiece and sweatband that is bi-axially stretchable.

A free-size cap is described in U.S. Pat. No. 5,715,540 to Cho. In this patent, a sweatband made of a uni-axially stretchable fabric is sewn into the interior lower periphery of a multi-gored cap. In addition, a conventional flat bill is attached to the crown. The Cho reference attempts to address increased manufacturing costs associated with single-size caps, lost aesthetic appeal, and decreased comfort associated with multi-size caps. However, it only partially addresses some of the problems. The Cho reference does not disclose or teach the use of a sweatband made of bi-axially stretchable fabric to provide greater comfort and fit. Further, Cho does not describe the use of an arched bill to coach with the stretchable sweatband to provide improved fit.

It is an object of the present invention to provide a baseball-style cap or a visor having a structure which is capable of multi-size use and which is comfortable, functional and attractive in its use and appearance.

Other and further objectives of the present invention will become apparent to those skilled in the art upon a study of the following detailed description, the appended claims, and the accompanying drawings. The invention will be described in greater detail below with reference to an embodiment which is illustrated in the drawings.

SUMMARY OF INVENTION

The present invention is directed to an adjustable headwear having an appearance of being fitted comprising a headpiece, made of uni-axially stretchable material stretchable in a chordial direction around the head, formed to fit around the head and fixably attached to a front portion of the headpiece, a bill for shading the eyes from sunlight also made of uni-axially stretchable material stretchable across the width of the bill, and stretchably stitched to the interior peripheral edge of the headpiece is a sweatband made of bi-axially stretchable material stretchable chordially and in a direction perpendicular thereto.

The adjustable headwear may be in the form of a cap with a multi-gore shell forming a crown and attached to the crown portion, a bill portion for shading the eyes. The adjustable headwear of the present invention may also be a visor with a headband and a bill portion attached to the headband. The adjustable headwear according to the present invention is preferably formed in two sizes, one size to get a standard range of head sizes from S to M (small to medium), and another to fit L to XL (large to extra-large).

The structure of the present invention permits a cap to be designed which is attractive in use, comfortable for the wearer, and further provides the advantageous feature of multiple size capability without requiring an open back portion or adjustment of an adjustable strap member or the like.

Another significant advantage of the adjustable headwear according to the present invention is that it has the aesthetic appeal of a fixed-size headwear, being capable of custom fitting all wearers within a predetermined range of head sizes, without the use of an unsightly adjustable fastener portion and/or opening on the back of the cap or visor.

A further significant advantage of the adjustable headwear according to the present invention is that it is capable of comfortably fitting all wearers within a predetermined range of head sizes like a custom fitted headwear, without the unsightly distortion in shape or the discomfort due to differences in head size.

DETAILED DESCRIPTION OF THE INVENTION

Figure 1:
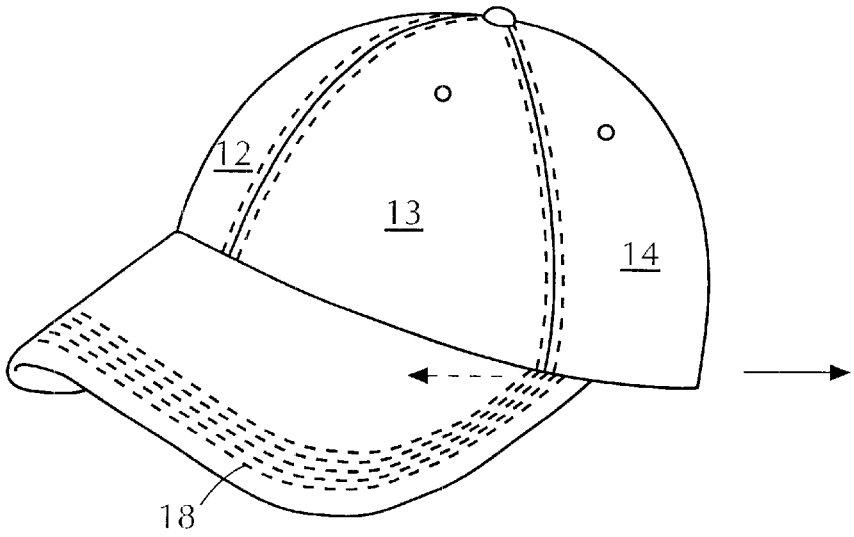
FIG. 1 is a side elevational view of an adjustable cap with a bi-axially stretchable sweatband in accordance with the present invention.

The present invention is described and illustrated by means of the drawings attached. It is not intended, however, to limit the scope of the invention to that presented in the drawings.

Figure 2:
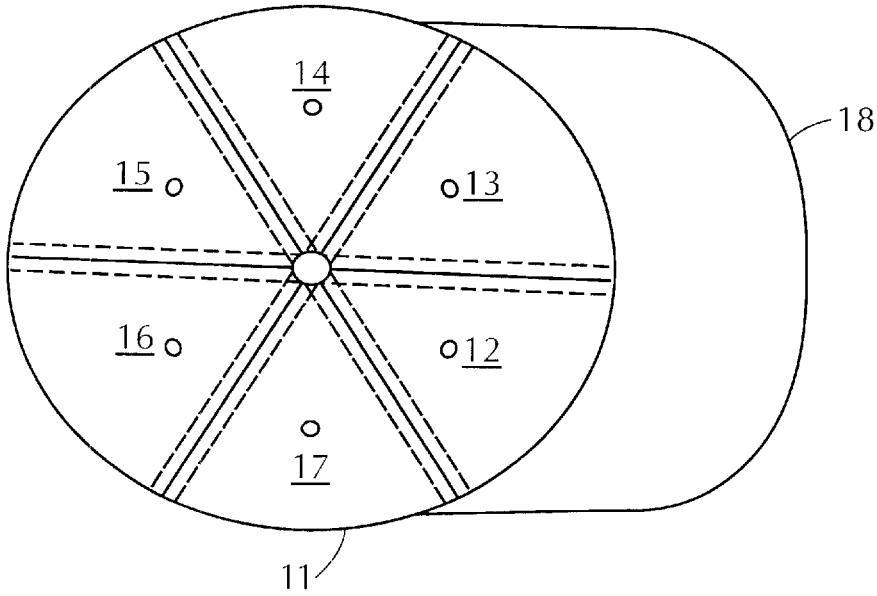
FIG. 2 is a top plan view of the cap shown in FIG. 1.

FIGS. 1 and 2 show the side and top elevational views of a cap 10 in accordance with the present invention, having a crown portion formed by a multi-gore shell 11. The multi-gore shell 11 is formed by a plurality of gores 12, 13, 14, 15, 16 and 17. An arched bill portion 18 is secured to a forward edge of the multi-gore shell 11 and extends outwardly therefrom. All gores (12, 13, 14, 15 16, and 17) are composed of a uni-axially stretchable woven fabric, stretchable in a chordial direction around the head, in a peripheral direction of cap 10, i.e., in a direction along the lowermost edge of cap 10. An aperture may be provided in each gore 12, 13, 14, 15, 16, and 17 to allow the release of heat and moisture, thus providing ventilation to cap 10.

According to the present invention, the crown of a cap or the headband 19 of a visor is formed from material that is uni-axially stretchable in the chordial direction of the cap structure. In other words, the material is incorporated in such a way that the uni-axial stretch occurs in the direction horizontal to the edge-band of the cap around the head of the wearer. Such a material is utilized in the crown or headband and co-acts with the bi-axially stretchable sweatband to achieve much improved fit and comfort for the wearer. A bill is secured to the forward edge of the crown and extends outwardly therefrom.

It is desirable for the forward portion of the crown, i.e., the portion adjacent the bill to be somewhat rigid so that the crown portion adjacent the bill stands somewhat erect. This enhances the appearance of the cap. Also, this construction provides a means for the bill portion to be rigid, durable, and extend generally forward of the wearer's forehead.

The bill portion 18 is attached to the front portion of cap 10. The bill of the adjustable headwear according to the present invention is also made of uni-axially stretchable material, stiffened with a more rigid material. Preferably, the bill of the headwear of the present invention is arched to provide a functional advantage of increased flexibility to the front of the headwear thereby further improving the fit. Because the bill is comprise of a material that makes it more rigid, the arched shape partially flattens out when the sweatband has been stretched to provide improved fit to the front of the head of the wearer. The pre-fabricated arch also provides aesthetic appeal. Many users of conventional flat-billed headgear attempt manually to bend the bill until an arch is formed. In a preferred embodiment, the bill is arched and may be flexed to allow gores 12 and 13 to better fit the front of the head of the wearer.

The gores 12 and 13 could also be partially formed of non-stretchable material, allowing a decal, decorative emblem, or logo to be displayed at the front of cap 10. That is, the interior of gores 12 and 13 may have attached thereto fitted or stiffened materials known in the art to provide it with a desirable shape. Such material may be a nylon web or other stiffening material known to those of skill in the art, such as Buckram available as Oxford Buckram or TR/T Buckram. Alternately, gore members 12 and 13 may be made of a stiffer fabric to provide support and shape for the cap 10. The rigidity of the gores 12 and 13 would provide for a crown which stands generally erect, and would thereby enhance the appearance of the cap, particularly adjacent and above the bill 18. The combination of the generally stiffened gores 12 and 13 with stretchable woven gores 14, 15, 16 and 17, enhances the ability of the cap 10 to exactly fit all normal head sizes. In addition, gores 12 and 13 in combination with an arched bill are somewhat flexible to provide improved fit to the front of the cap.

For purposes of achieving substantially universal utilization with a single cap structure, the material forming the crown portion is selected so that it is capable of a 10 percent stretch along one axial direction. Such material is available commercially. The stretchability of the material is provided by the presence of an elastic yarn, such as spandex yam or a polyurethane elastic yarn, in the weft of the fabric, which enables the fabric to expand and contract along the chordial direction of the crown of cap 10. More specifically, the crown of the cap and the outer surfaces of the bill of the adjustable cap according to the present invention are made of a woven or a knitted fabric that has a 6 cm range of stretchability at the length of 60 cm in the weft direction. Examples of fabrics commercially available include a stretchable cotton twill woven from a blend of 96%–98% cotton and 4%–2% spandex, a stretchable wool blend woven from a blend of 10% wool, 86% Acrylic and 4% spandex, a knitted fabric made of cotton or a synthetic fiber yarn with a small amount of spandex in the weft direction, a material of blended spun yarn with 70% polyester and 30% wool with the polyurethane elastic yarn woven in the weft direction, and a material of blended spun yarn with 70% polyester and 30% wool with a small amount of spandex or the like in the weft direction.

Figure 3:
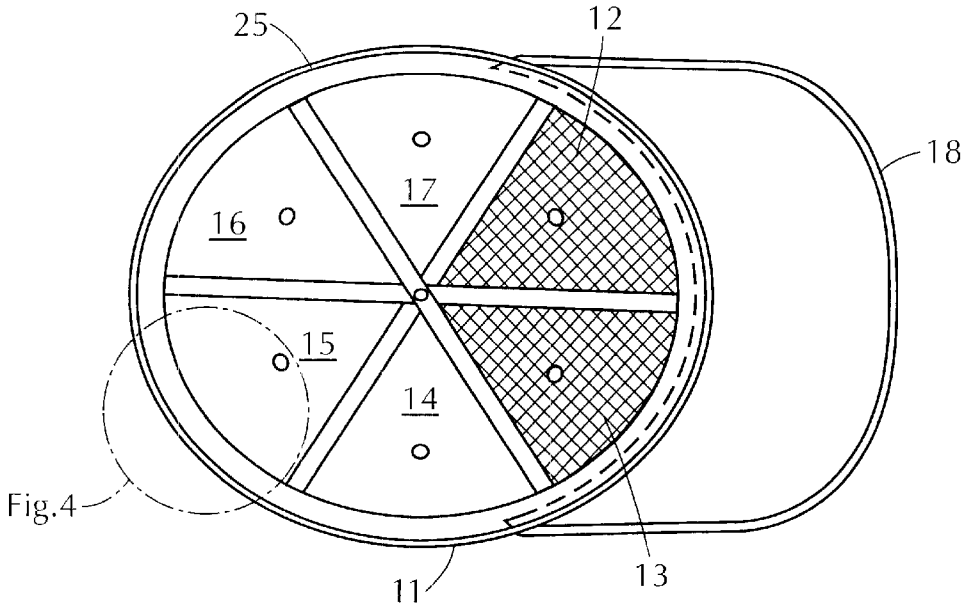
FIG. 3 is a bottom view of an adjustable cap shown in FIG. 1 showing the interior of the crown portion of the cap.

FIG. 3 which is an enlarged bottom view of the inside of the cap 10 shown in FIG. 2 shows a sweatband 25 arranged along the periphery of the interior of the crown portion 11 of the free-size cap 10. The sweatband 25 is made of a bi-axially stretchable fabric, so that it can stretch along with the stretching of the gores 12, 13, 14, 15, 16 and 17 and also in a direction perpendicular thereto. The fabrics suitable for the sweatband of the present invention are woven or knitted with stretchable yarn providing the elasticity necessary to exactly fit all head sizes and the ability to absorb sweat. The bi-axially stretchable material useful in the headwear of the present invention has a stretchability of more than 1 inch along the perimeter and more than ¾" in a direction perpendicular thereto to cover a wide range of sizes. The material may be a knitted material comprised of a blend of 76% cotton, 20% polyester, and 4% spandex yarns; and a commercially available woven material of blended polyester and spandex yarn (Jinwan Woven Band Co., Shanghai, China). This stretchable feature of the fabrics employed permits the headwear to be adjustable to fit all usual head sizes of children and adults. The bi-axial stretchability of the sweatband also provides a surprisingly greater degree of comfort and fit than provided with uni-axial stretchable material.

Figure 4:
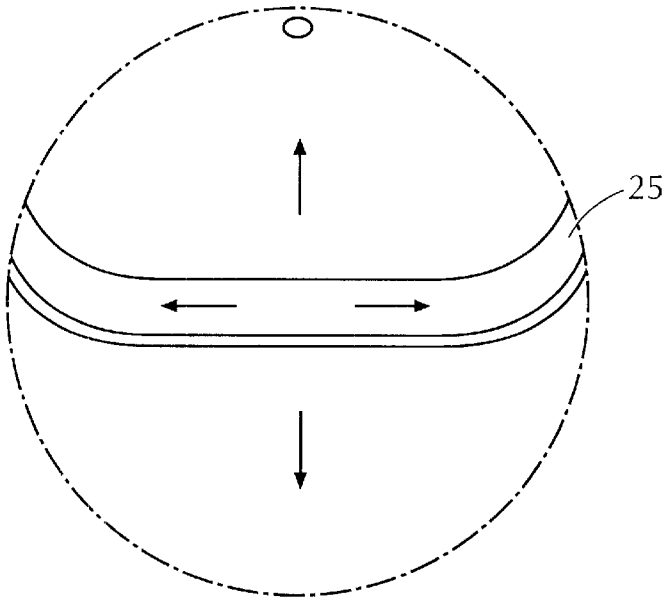
FIG. 4 is an enlarged view of a portion of FIG. 3 illustrating the stretching of the sweatband of a cap.
Figure 5:
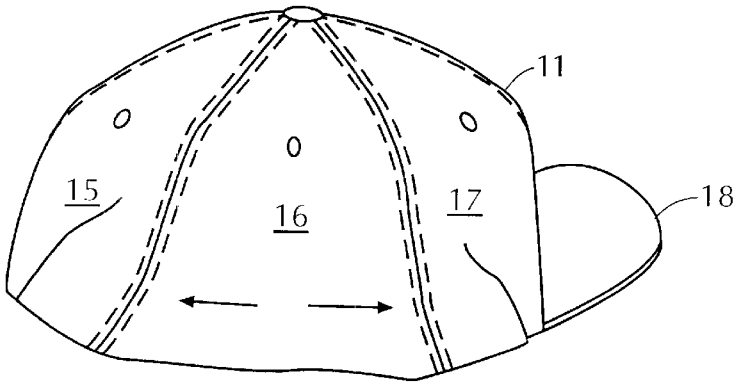
FIG. 5 is a perspective view of a rear gore or panel of the cap similar to FIG. 1, and showing stretching of the gore or panel in a peripheral direction.
Figure 6:
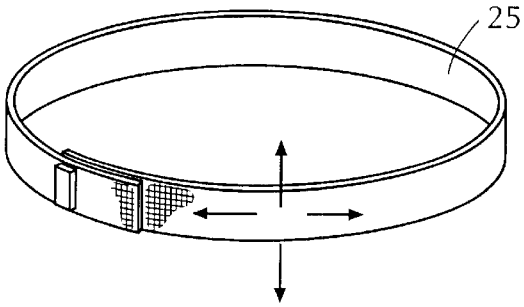
FIG. 6 is a view of the sweatband according to the present invention.
Figure 7:
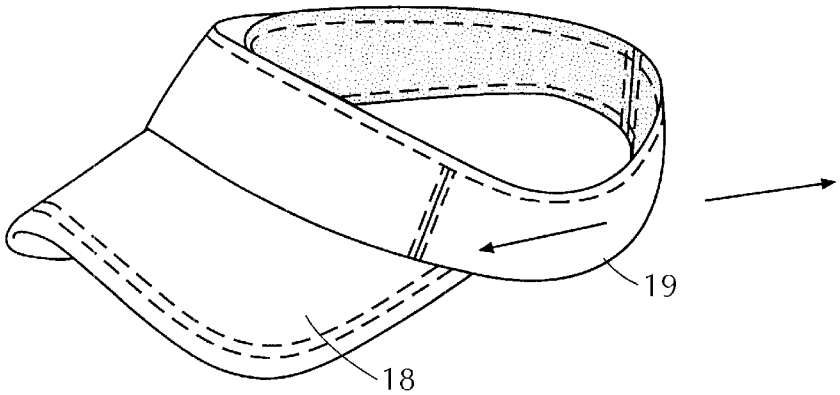
FIG. 7 is a perspective view of a visor with a bi-axial stretchable sweatband according to the present invention.

FIG. 4 shows a portion of the isolated sweatband being stretched in bi-axial directions. FIG. 5 shows the gore 16 at the rear of the cap which stretches when opposite forces are applied in opposite directions to the lower periphery thereof. FIG. 6 is a view of the sweatband according to the present invention, isolated from the crown portion of the cap. The sweatband is in the form of a closed loop. The sweatband is attached by stitching to the interior of the bottom periphery of the crown portion of cap 10. The stitching used is such that it provides stretchability, i.e. the thread may be elastic or the stitching may be done in a zig-zag pattern or with very loose tension.

This illustrates the stretching of the sweatband in the cap and the visor. The bi-axially stretchable sweatband allows for uniform stretching co-acts with the uni-axial stretchable gore sections 14, 15, 16, and 17 or the portion of the headband 19 not attached to bill 18, in the circumferential direction. The bi-axial material of the sweatband prevents the narrowing of the sweatband which causes uncomfortable constriction around the head. In the preferred embodiment, the arched shape of the bill 18 provides flexibility to the more rigid gore sections 12, 13. Together with the sweatband and the gore sections 14, 15, 16 and 17, the headwear for the present invention provides improved fit and comfort to the wearer.

The uni-axially stretchable material used in both the crown or the headband 19 with the bi-axially stretchable sweatband provides a headwear that fit and is comfortable to the wearer. Furthermore, the arched shape of the bill providing flexibility to the front portion of the cap or visor and allows the cap or the visor to fit the front part of the head comfortably without losing the desired appearance of the cap or visor. The hearwear of the present invention, therefore, provides desirable comfortable fit and aesthetic appeal.

It will be understood that the above description of the present invention is susceptible to various modifications, changes and adaptations, and the same are intended to be comprehended within the meaning and range of equivalents of the appended claims.

I claim:

1. An adjustable headwear having an appearance of being fitted comprising a headpiece formed to fit around the head and, fixably attached to a front portion of the headpiece, a bill for shading the eyes, said headpiece and bill being made of a uni-axially stretchable fabric stretchable in a chordial direction of at least 10% around the head and across the bill, said uni-axially stretchable fabric being woven or knitted from a blend of yams with an elastic yam in a weft direction and elastically stitched to an interior peripheral edge of the headpiece is a sweatband made of bi-axially stretchable material stretchable more than 1 inch chordially and stretchable more than ¾" in a direction perpendicular thereto, said bi-axially stretchable material being selected from a group consisting of a) knitted material comprised of 76% cotton 20% polyester, and 4% spandex, and b) a woven material comprised of multiple uni-axially stretchable polyester yarn and spandex in both directions.

2. An adjustable headwear as claimed in claim 1, wherein said bill on an outer surface is composed of said uni-axial stretch material enclosing a stiffening material, said bill being flexible with the front portion of the headwear attached to said bill.

3. An adjustable headwear as claimed in claims 1 or 2, wherein said headpiece comprises a plurality of gores forming a crown portion of a cap with a lower peripheral edge, and wherein at least a plurality of gores in the front are composed of said uni-axially stretchable fabric aligned to stretch only in a peripheral direction backed with a stiffening material, said stiffening material being selected from the group consisting of nylon web, and Buckram.

4. An adjustable headwear as claimed in claim 3 wherein the uni-axially stretchable fabric is selected from a group consisting of a stretchable cotton twill woven from a blend of 96%–98% cotton and 4%–2% spandex in a weft direction; a stretchable wool blend woven from a blend of 10% wool, 86% Acrylic and 4% spandex in a weft direction; a knitted fabric made of cotton or a synthetic fiber yarn with a small amount of spandex in a weft direction; a material of blended spun yarn with 70% polyester and 30% wool with a polyurethane elastic yarn woven in a weft direction; and a material of blended spun yarn with 70% polyester and 30% wool with a small amount of spandex or a polyurethane elastic yarn in a weft direction.

5. An adjustable headwear as claimed in claim 4 wherein the uni-axially stretchable material is a woven fabric made of a stretchable cotton twill woven from a blend of 96%–98% cotton and 4%–2% spandex in a weft direction.

6. An adjustable headwear as claimed in claim 4 wherein the uni-axially stretchable material is a woven fabric made of a stretchable wool blend woven from a blend of 10% wool, 86% Acrylic and 4% spandex in a weft direction.

7. An adjustable headwear as claimed in claim 4 wherein the uni-axially stretchable material is a knitted fabric made of cotton or a synthetic fiber yarn with a small amount of spandex in a weft direction.

* * * * *